US011052695B2

(12) United States Patent
Müller et al.

(10) Patent No.: US 11,052,695 B2
(45) Date of Patent: Jul. 6, 2021

(54) BOOK PRODUCTION LINE AND METHOD FOR PRODUCING INDIVIDUAL BOOKS AS WELL AS VERY SHORT AND SHORT RUNS OF BOOKS

(71) Applicant: Müller Martini Holding AG, Hergiswil (CH)

(72) Inventors: Hans Müller, Lauda-Königshofen (DE); Stefan Gärtner, Creglingen (DE)

(73) Assignee: MÜLLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 16/824,923

(22) Filed: Mar. 20, 2020

(65) Prior Publication Data

US 2020/0324566 A1 Oct. 15, 2020

(30) Foreign Application Priority Data

Apr. 11, 2019 (CH) ..... 00493/19

(51) Int. Cl.
*B42C 11/04* (2006.01)
*B42C 19/00* (2006.01)
(Continued)

(52) U.S. Cl.
CPC ..... *B42C 11/04* (2013.01); *B42C 5/02* (2013.01); *B42C 13/00* (2013.01); *B42C 19/00* (2013.01); *B42C 19/08* (2013.01)

(58) Field of Classification Search
CPC ..... B42C 11/04; B42C 19/00; B42C 19/08
(Continued)

(56) References Cited

U.S. PATENT DOCUMENTS 5,777,443 A * 7/1998 Chang ..... B42C 19/00 270/52.17
6,250,868 B1 * 6/2001 Schmucker ..... B42C 19/00 412/13

(Continued)

FOREIGN PATENT DOCUMENTS

DE 19729529 A1 3/1998
DE 102008034065 A1 2/2010

(Continued)

OTHER PUBLICATIONS

International Search Report in related Swiss Patent Application No. 4932019, dated Apr. 25, 2019, 3 pages.

*Primary Examiner* — Kyle R Grabowski
(74) *Attorney, Agent, or Firm* — FisherBroyles, LLP; Robert Kinberg

(57) ABSTRACT

The invention relates to a book production line and a method for producing individual books as well as very short and short runs of books. The book production line comprises a feed device and a following transport section for book covers, a feed device and a following transport and processing section with a rounding and pressing machine, an adhesive-backing apparatus for book blocks, and a casing-in machine. The rounding and pressing machine forms an upstream-arranged, first adjustment segment. The adhesive-backing apparatus is divided into at least two additional adjustment segments that successively follow each other in a transport direction of the book blocks. Each adjustment segment includes a separate drive and a number of book block positions which is the same for each adjustment segment or differs maximally by three book block positions.

14 Claims, 6 Drawing Sheets

(51) Int. Cl.
*B42C 19/08* (2006.01)
*B42C 5/02* (2006.01)
*B42C 13/00* (2006.01)

(58) Field of Classification Search
USPC ..... 412/19, 21
See application file for complete search history.

(56) References Cited

U.S. PATENT DOCUMENTS

| | | | | |
|---|---|---|---|---|
| 6,352,252 | B1 * | 3/2002 | Schmucker | B42C 19/08 198/502.2 |
| 7,210,887 | B2 * | 5/2007 | Engert | B42C 9/0031 270/52.18 |
| 7,927,056 | B2 * | 4/2011 | Brommer | B42C 9/0037 412/21 |
| 8,475,104 | B2 * | 7/2013 | Mueller | B42C 19/08 412/13 |
| 8,613,581 | B2 * | 12/2013 | Winkelmann | B42C 19/08 412/13 |
| 2009/0155022 | A1 * | 6/2009 | Garlichs | B42C 19/08 412/21 |

FOREIGN PATENT DOCUMENTS

| | | | |
|---|---|---|---|
| EP | 2386513 | A1 | 11/2011 |
| EP | 2508355 | A1 | 10/2012 |

* cited by examiner

BOOK PRODUCTION LINE AND METHOD FOR PRODUCING INDIVIDUAL BOOKS AS WELL AS VERY SHORT AND SHORT RUNS OF BOOKS

CROSS-REFERENCE TO RELATED APPLICATION

Priority is claimed to Swiss Application No. 00493/19, filed Apr. 11, 2019, the disclosure of which is incorporated herein by reference in its entirety.

BACKGROUND OF THE INVENTION

The invention relates to a book production line for producing individual books as well as very short and short runs of books. For this, the book production line comprises a feed device and a following transport section for book covers, a feed device and a following, segmented transport and processing section with a rounding and pressing machine, and an adhesive-backing apparatus for book blocks, as well as a casing-in machine in a downstream direction for combining a book cover with an associated book block to form a book. The transport and processing section has individual adjustment segments with separate drives that follow successively in the transport direction of the book blocks and which have respectively a number of book block positions.

The invention furthermore relates to a corresponding method for producing individual books as well as very short and short runs of books with the aid of such a book production line.

For the conventional production of medium-sized to large runs of books, known book production lines combine in a clocked operation respectively one book block with one book cover, wherein the book blocks and the book covers are generally first produced in separate machines. In a book production line, such as the one known from the German patent document DE 19729529 A1, the book block passes separately from the associated book cover through various processing stations, for example stations for rounding, pressing, glue application to the back and attaching of capitals. Starting with a cover feeder, the book covers are initially separated, are then transported through a cover shaping apparatus and are subsequently shaped inside a thermal folding and back-forming apparatus to match the associated book blocks before the so-called marriage takes place in a following casing-in machine, meaning where the book cover is combined with the book block to form a book.

An equal number of book covers are therefore always available for a specific number of book blocks. Attention need not be paid to a sequence of the book blocks or the book covers because all books of an edition are composed in the same way. With a following production order for books of a different edition, book production lines of this type are on the whole correspondingly converted, wherein the conversion time decreases with an increase in the size of the run.

However, the concept of a total conversion was abandoned for producing even short runs economically with a conventional book production line. For this, the transport and processing section of the book production line was divided into separate, individually adjustable production units which are also referred to as adjustment segments. Among other things, a corresponding production line for book blocks is provided with several interlinked production units having separate drives. These adjustment segments can comprise a book block feeder with warming section, a rounding and pressing machine, an adhesive-backing apparatus, and a casing-in machine. However, this type of segmenting results in adjustment segments with a varying number of possible book block positions. Thus, the book block feeding section may contain three to five book block positions, the rounding and pressing machine may contain six book block positions, the adhesive-backing apparatus may contain more than ten book block positions and the casing-in machine could contain two book block positions for holding and/or transporting and/or processing of book blocks until the marriage with the book covers.

For producing personalized books on the other hand and for the individual book production, such as books containing photographs, the book block and the book cover are unique. An unambiguous identification of these book components is therefore necessary, which can be realized by reading a bar code affixed thereto that contains a corresponding format information. To ensure a smooth sequence for the book production, either the book covers or the book blocks in that case assume a control function. An automatic conversion of the book-production line can thus take place even before the book cover or the corresponding book block is inserted into the production unit.

With modern industrial book production, orders for short runs frequently alternate with orders for very short runs and individual books. For the individual production, the number of books to be processed is around 200 items per hour, for very short runs of up to ten books, it is approximately 900 items per hour and for short runs of up to 500 books, the output is approximately 2000 per hour. In particular for very short runs and individual editions, the previously described type of division of the conventional book production lines with differently long adjustment segments, meaning having a varying number of book block positions, is very unfavorable and does not result in an economic production.

For very short runs, the depositing of book blocks onto the adjustment segments furthermore differs considerably from that of the individual book production. Whereas for very short runs, several book blocks and associated covers are positioned simultaneously in the book production line and are processed sequentially, only a single book block is located in the region of the adhesive-backing apparatus for the individual book production. The following book block, on the other hand, is positioned upstream of the adhesive backing section. In addition, only a single book cover is located in the region of the cover feeder for the individual book production. The following book cover provided for a following individual book, on the other hand, is still positioned in the upstream individual feeder. If it is determined at that point in time that the two book components for the following individual book production, meaning the following book block and the book cover, do not match (so-called mismatch), then one of the book components can be removed or discharged without problem in the upstream region of the book production line. In contrast, with very short runs the book blocks which are located on the adhesive-backing apparatus or in the region of the casing-in machine, and the book covers already positioned in the region of the cover feeder or the casing-in machine, can no longer be removed or discharged.

When producing short or very short runs of books with a conventional book production line, the machines would always have to be stopped when feeding an additional book block into a conveying section of the book production line, meaning for inserting it between the book blocks already sequentially moved along the conveying section. Owing to said disadvantage, there have not been any attempts so far to feed individual book blocks in this way into such book production lines.

Nevertheless, it has turned out that during the operation of such book production lines, the removal or feeding in of individual book covers or book blocks in some cases is necessary, for example if the book covers and the book blocks must travel differently long distances on the book production line. Thus, it can happen that matching book blocks for the book covers located on the book production line are not yet available. Also conceivable are irregularities such as when a book block is damaged during previous processing steps or other quality defects are detected. In those cases, it can make sense to remove a book block prior to its marriage with an associated book cover. Known in that respect is the practice of assigning an idle stroke to a missing book block on the conveying section and to discharge the associated book cover at a corresponding location.

European patent document EP2386513 A1 deals with the problem of the targeted and flexible integration of book covers into a book production line, suitable for short or very short runs, and the secure allocation of matching book covers and book blocks. For this, the book covers of an order stack of unknown composition are initially separated, identified and the sequence determined, so that finally a stack of detected book covers can be formed with these. The information for the composition of this stack of detected book covers is transmitted to the control of the book production line, so that the respectively matching book blocks can be made available in the book production line.

European patent document EP 2508355 A1 discloses a method for removing from or feeding in at least one book block from and/or into the conveying section of a book production line, in particular used for producing very short runs. Following the feeding of a stack of book covers and a number of book blocks to the book production line, a marker is identified on at least one of the book covers of the supplied stack. The identified marker is transmitted further to the control of the book production line. Wing to this marker, the control then assigns to the supplied stack a data set stored in the control for the sequence of the book covers in this stack. Based on the markers of the supplied book blocks, a sequence for these book blocks is determined in the control and is compared to the data set for the sequence of the book covers. As a result of this comparison and if the book cover sequence differs, the control then triggers the removal or feeding in of at least one book block, thus making possible a cost-effective and uninterrupted removal or feeding of book blocks from or into the feeding section.

SUMMARY OF THE INVENTION

It is an object of the invention to create a segmented book production line with several interlinked individual machines provided with separate drives, which can be used for the economic production of very short or short runs of books as well as individual books. A corresponding method for operating such a book production line is also disclosed.

The above and other objects are solved according to one embodiment of the invention in which a book production line for producing individual books as well as very short and short runs of books, comprises: a first feed device for book covers; a transport section following the first feed device for transporting the book covers received from the first feed device: a second feed device for book blocks; a segmented transport and processing section following the second feed device for transporting the book blocks received from the second feed device in a transport direction; a casing-in machine at a downstream end of the transport section and of the transport and processing section for combining a book cover and an associated book block to form a book; wherein the segmented transport and processing section includes individual adjustment segments including: an upstream first adjustment segment receiving the book blocks from the second feed device and comprising a rounding and pressing machine; and at least two downstream adjustment segments that constitute an adhesive-backing apparatus following the rounding and pressing machine and that successively follow each other in the transport direction; wherein each of the upstream segment and the at least two downstream adjustment segments includes an associated separate drive and respectively have a number of book block positions; and wherein the number of book block positions in each adjustment segment is identical or the number of book block positions in each adjustment segment maximally differs by three book block positions.

The above and other objects are also solved with a method for producing individual books as well as very short and short runs of books in a book production line, which in one embodiment comprises: separately supplying book covers and book blocks to a casing-in machine of the book production line, wherein respectively one book cover and an associated book block are combined in the casing-in machine to form a book, the separately supplying step comprising: upstream of the casing-in machine, rounding and pressing book blocks in a first adjustment segment of a transport and processing section in which the book blocks are transported downstream toward the casing-in machine, each book block having a back; following the rounding and pressing step, adhesively applying backing material to the backs of the book blocks while positioned on at least two downstream adjustment segments of an adhesive-backing apparatus of the transport and processing section, wherein the at least two downstream adjustment segments successively follow each other in the transport direction of the transport and processing section, wherein each of the first and the at least two adjustment segments includes a separate drive and a number of book block positions; and converting the book production line from a current production order with a first book format to a following production order with a second book format that differs from the first book format while maintaining a format conversion time of one of the downstream adjustment segments equal to or less than a transit time of a book block through the adjustment segment adjoining and upstream from the one downstream adjustment segment. In this way, it is achievable, that the conversion of a downstream adjustment segment is completed at the latest, when the following book block is conveyed into this adjustment segment.

The book production line and method according to the invention for producing very short runs and individual books are distinguished in that during the production an empty adjustment segment alternates therein with an occupied adjustment segment. To the degree that the continuous processing or the transport of at least one book block takes place in an adjustment segment, the following empty adjustment segment is converted to match the format of this at least one book block. The segment size here depends on the format conversion time, and the invention takes into account that for a conversion of the book production line from a current production order with a first book format to a following production order with a second book format that differs from the first book format, the format conversion time of an adjustment segment and the transit time through this adjustment segment basically are the same.

According to one advantageous embodiment of the book production line according to the invention, the adjustment segments respectively have five book block positions. With five book block positions, meaning five operating cycles and a turnover cycle to the respectively following post-processing, the transport and processing section of the book production line can be converted without increased operating expenditure, such that depending on the sequence of the orders to be processed, book blocks having a minimum or maximum format can be processed sequentially one after another. Since all adjustment segments of this embodiment comprise five book block positions, the transit time through the adjustment segments is the same, thus ensuring the same format conversion time for a following book block with a different format in the respectively adjacent adjustment segment.

According to a different advantageous embodiment of the inventive book production line, the adjustment segments of the adhesive-backing apparatus are each provided with a transport device connected to a separate drive and have a separation point, wherein an additional transport device with separate drive is arranged in the region of the separation point for bridging this location. A mechanical separation of these adjustment segments is needed since the farthest downstream-arranged adjustment segment of the transport and processing section of the adhesive-backing apparatus can be operated at least in part with operating cycles moving in a single or double step, and can thus be moved a differently long transport distance as compared to the upstream-arranged adjustment segment, wherein this separation represents a simple and cost-effective solution.

According to a different embodiment of the inventive book production line, either the feed device or the transport and processing section for book blocks is provided with a detection device, and the transport and processing section is provided with a book block removal station, arranged downstream thereof, wherein the detection device and the removal station are operatively connected to a machine control of the book production line. In case of a mismatch, the corresponding book block can thus be identified and can be automatically discharged or manually removed, advantageously still within the adhesive-backing apparatus.

A different embodiment of the inventive book production line requires that the book block removal station is arranged in the region of an upstream book block position of a farthest downstream arranged adjustment segment of the transport and processing section. As a result, the discharge or removal of a book block in case of a mismatch can still occur relatively late, meaning a few operating cycles before the planned turnover to the casing-in machine.

According to another embodiment of the inventive book production line, the adjustment segment of the transport and processing section, which is located farthest downstream, has two downstream book block positions with a single transport path within the casing-in machine, and has three upstream book block positions with double transport path within the adhesive-backing apparatus. Owing to this relatively simple and cost-effective measure, a segment size for five book block positions can also be generated with this adjustment segment.

The transport and processing section for book blocks of a different embodiment of the inventive book production line has at least three adjustment segments, thereby advantageously resulting in a balanced ratio of flexibility for the transport and processing section and the associated costs for individual drives for the adjustment segments.

According to a different embodiment of the inventive book production line, the feed device or the transport section for book covers comprises a detection device and a downstream-arranged removal station for book covers, wherein the detection device and the removal station are operationally connected to a machine control of the book production line. In case of a mismatch, a corresponding book cover can thus be detected and purposely discharged.

According to one advantageous embodiment of the inventive method, the book covers transported by the transport section as well as the book blocks conveyed through the transport and processing section are identified. Respectively one book cover is checked to ensure that it belongs to the associated book block. In case of a mismatch, at least one of the book components is automatically discharged or manually removed from the transport section for book covers or the transport and processing section for book blocks. In this way, mismatches can be prevented during the running book production either when producing very short runs or individual books.

According to a different embodiment of the inventive method, the adjustment segments that follow successively in transport direction of the book blocks are operated in such a way that they alternately carry or do not carry a book block, wherein a format conversion for one of these adjustment segments occurs when said adjustment segment does not carry a book block. Accordingly, a book block can be transferred to the following segment only if this segment was previously adjusted to match the corresponding format at the end of an adjustment segment where a processing or transport took place. Owing to this sequential operation of the inventive book production line, it is possible to noticeably improve the cost efficiency of producing very short runs of books and individual books, as compared to conventional book production lines. Of course, the production of a single book can be followed by the production of another single book or also several single books, but also the production of one or several very short or short runs of books.

A further embodiment of the inventive method calls for operating the adjustment segments with respectively five operating cycles. During the resulting format conversion time for five book block positions and the transfer cycle, the adjustment segments can be adjusted to the format of the following book block or blocks, meaning this format conversion time permits an adjustment between minimum and maximum book block format. No increased expenditure for the drive technology of the adjustment segment is therefore required, for example ball screw spindles or relatively expensive servo drives.

According to a different embodiment of the inventive method, a farthest downstream-positioned adjustment segment of the transport and processing section that connects the adhesive-backing apparatus and the casing-in machine is operated in the adhesive-backing apparatus with three operating cycles, respectively traversed in a double step, and in the casing-in machine with two operating cycles, respectively traversed in a single step. With such a relatively simple and cost-effective method, a segment size of five book-block positions can also be realized with this adjustment segment.

Corresponding to an alternative embodiment of the inventive book production line, an adjustment segment for the transport and processing section, positioned farthest downstream, has three book block positions more than any of the other adjustment segments. The adjustment segment of an alternative embodiment of the inventive method, which connects the adhesive-backing apparatus and the casing-in machine and is located farthest downstream, is operated in the adhesive-backing apparatus with six operating cycles that are respectively traversed in a single step, and in the casing-in machine with two operating cycles which are traversed in a single step. With this arrangement and the corresponding method, the book production line can be operated faster because of the continuous single step rather than if a double step is used. Despite a lower machine capacity (books per time unit) for producing individual books, this alternative solution is advantageous, especially for short runs, because the format conversion times are not as relevant in that case as for the individual book production or the production of very short runs. In case of smaller deviations in the adjustment segments for the number of book block positions, for example deviations involving two or only one book block position, the respective advantages and disadvantages are put into perspective, depending on the type of production order (individual books, very short or short runs).

BRIEF DESCRIPTION OF THE DRAWINGS

The invention is explained further in the following with the aid of exemplary embodiments, showing in.

DETAILED DESCRIPTION OF THE INVENTION

Figure 1:
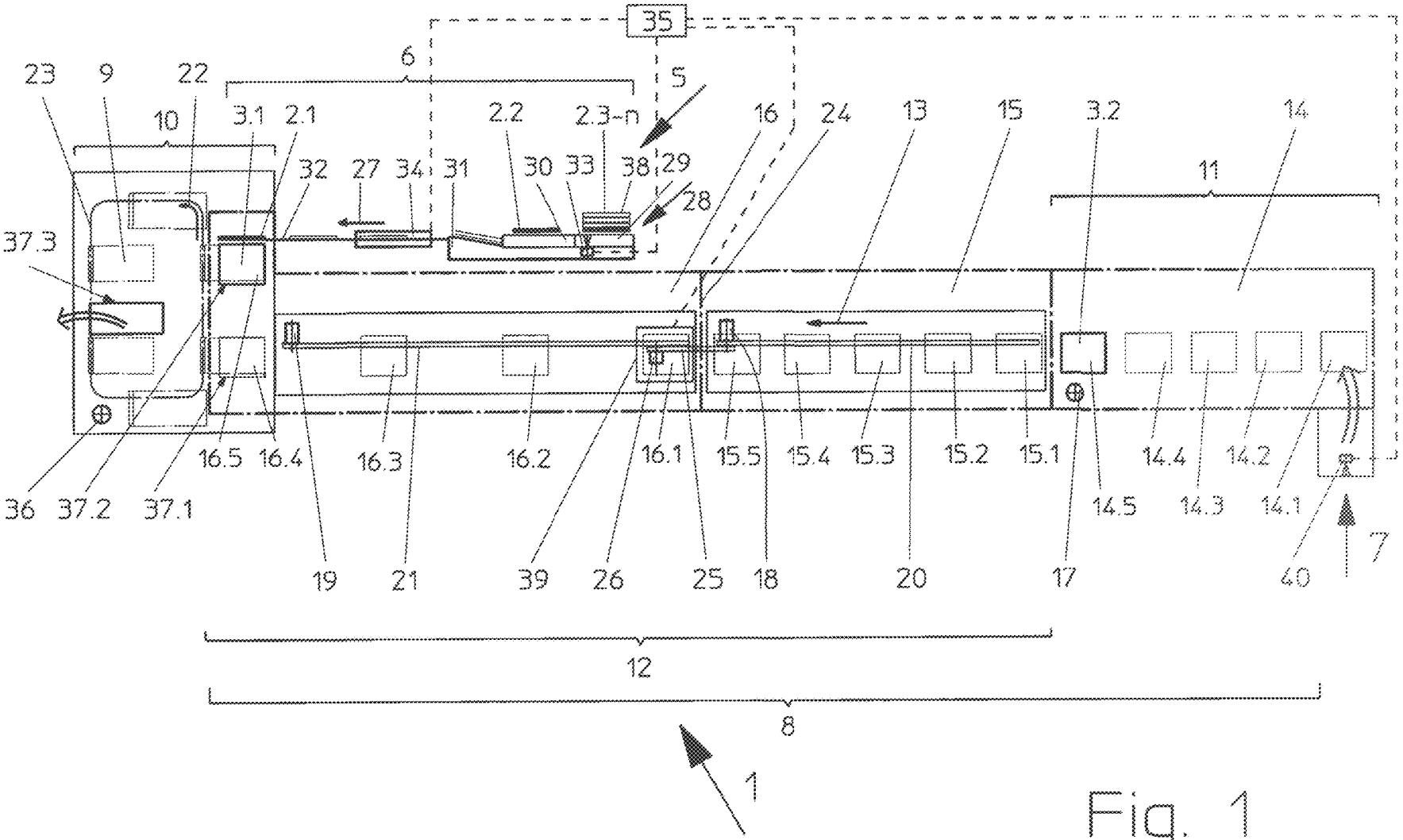
FIG. 1 is a schematic view of a book production line used for producing individual books according to the invention.

FIG. 1 shows a schematic view of an exemplary embodiment of a book production line 1 according to the invention for producing several editions of individual books 4.1-*n* (FIG. 2) which are respectively composed of a book cover 2.1-*n* and the associated book block 3.1-*n*. The book production line 1 comprises a feed device 5, indicated herein only with an arrow, and a following transport section 6 for the book covers 2.1-*n*, a feed device 7 and an adjoining transport and processing section 8 for the book blocks 3.1-*n*, as well as a casing-in machine 10, embodied as paternoster with circulating saddle plates 9, for combining a book cover 2.1-*n* with a book block 3.1-*n* to form an individual book 4.1-*n* (shown in FIG. 2) and for the further transport to a post-processing arrangement that is not shown herein.

The transport and processing section 8 for book blocks 3.1-*n* has an upstream-arranged rounding and pressing machine 11 and a downstream-arranged adhesive-backing apparatus 12 for book blocks 3.1-*n*. The transport and processing section 8 is furthermore embodied segmented and comprises three adjustment segments 14, 15, 16 that follow successively in transport direction 13 for the book blocks 3.1-*n* and can be adjusted to differing formats of the book blocks 3.1-*n* to be processed. The adjustment segments 14, 15, 16 respectively operate with five operating cycles and thus have five possible book block positions 14.1-5, 15.1-5, 16.1-5

As shown in FIG. 1, the rounding and pressing machine 11 comprises an upstream first adjustment segment 14 with a first individual drive 17, as well as non-depicted processing stations for rounding and pressing of the book blocks 3.1-*n*. The adhesive-backing apparatus 12 is divided into two successively following adjustment segments 15, 16, respectively driven by a separate drive, meaning a second and third drives 18, 19 and has non-depicted processing stations for the adhesive application, attaching of capitals, pressing and the transport of the book blocks 3.1-*n*. For this, the adhesive-backing apparatus 12 and the casing-in machine 10 are connected by the farthest downstream-positioned adjustment segment 16 of the transport and processing section 8, which simultaneously represents the downstream adjustment segment 16 of the adhesive-backing apparatus 12. For this, the adjustment segment 16 has three upstream book block positions 16.1, 16.2 and 16.3, located within the adhesive-backing apparatus 12, and two downstream book block positions 16.4, 16.5 which are located within the casing-in machine 10. The two adjustment segments 15, 16 of the adhesive-backing apparatus 12 furthermore comprise respectively one transport device 20, 21 for the book blocks 3.1-*n*, which are connected respectively to second and third individual drives 18, 19 embodied herein as transport belts. For transporting the book blocks 3.1-*n* within the downstream adjustment segment 16, the transport device 21 is adjoined by a transport device 23, e. g. embodied as a transport chain, of the casing-in machine 10, which moves the saddle plates 9 in circular direction 22. In the region of a separating location 24 between the two adjustment segments 15, 16 of the adhesive-backing apparatus 12, an additional transport device 25 for the book blocks 3.1-*n* is arranged for bridging this separating location 24, which has a separate drive 26 and can be embodied as transport belt.

Of course, it is also possible to use a number other than the herein described number of three adjustment segments 14, 15, 16 for the transport and processing section 8 for book blocks 3.1-*n*. Additional adjustment segments can be arranged, for example between the feed device 7 for the book blocks 3.1-*n* and the first adjustment segment 14 of the transport and processing section 8. An additional adjustment segment of this type can also be arranged between the rounding and pressing machine 11 and the adhesive-backing apparatus 12 or in the adhesive-backing apparatus 12 itself and can be embodied therein as a gauze station or as a station for gluing on the book ribbon. Other transport devices 20, 21, 25 can furthermore also be used, for example transport chains with buffering elements or transport skids with holding jaws.

In conveying direction 27 for the book covers 2.1-*n*, the transport section 6 is provided successively with a single feeder 28 with two transport devices 29, 30, not shown further herein and embodied, for example, as transport belts, as well as a hopper 31 and a third transport device 32 for the book covers 2.1-*n*. For book covers 2.1-*n*, a detection device 33 is arranged in the region of the first transport device 29 of the transport section 6 and a removal station 34 is arranged in an upstream region of the third transport device 32. The detection device 33 and the removal station 34 are operatively connected to a machine control 35 of the book production line 1 (FIG. 1). Of course, the detection device 33 can also be arranged further upstream, meaning already in the feed device 5 for the book covers 2.1-*n*.

The casing-in machine 10 has a separate drive 36, a number of processing stations, including a loading station 37.1 for respectively one book block 3.1-*n*, a loading and grinding station 37.2 that follows in counterclockwise circulating direction 22 of the casing-in machine 10, for respectively one book cover 2.1-*n* to be placed onto the book block 3.1-*n*, as well as a delivery station 37.3 for an individual book 4.1-*n* consisting of a single book block 3.1-*n* and the associated book cover 2.1-*n*. The transport section 6 for the book covers 2.1-*n* and the downstream adjustment segment 16 of the adhesive-backing apparatus 12 for book blocks 3.1-*n* overlap in the region of the loading and grinding-on station 37.2 of the casing in machine 10, which is intended for respectively fitting a book cover 2.1-*n* onto a book block 3.1-*n*.

To produce a first individual book 4.1, the book production line 1 is supplied by the feed device 5 with a first book cover 2.1 and via the feed device 7 with an associated book block 3.1. For this, the book covers 2.1-*n* are first deposited individually or in the form of a stack 38 onto the individual feeder 28 of the transport section 6. With the aid of the first transport device 29 of the individual feeder 28, a single book cover 2.1-*n* is then withdrawn from the stack 38 and is transported with the second transport device 30 of the individual feeder 28 to the hopper 31. Owing to the identification of the book cover 2.1-*n*, which previously took place in the region of the first transport device 29, an identified book cover 2.1-*n* is thus deposited in the hopper 31 and is then transported with the third transport device 32 in conveying direction 27 to the loading and grinding-on station 37.2 of the casing-in machine 10. The respective book cover 2.1-*n* is withdrawn from the stack 38 once the second transport device 30 is empty, meaning once the book cover positioned thereon has been inserted into the hopper 31 which has been converted to its format. Parallel to feeding in a book cover 2.1-*n*, an associated book block 3.1-*n* is transported starting from its feed device 7 in transport direction 13 through the first adjustment segment 14 of the transport and processing section 8 and, in the process, is rounded and pressed. This book block 3.1-*n* is subsequently transferred to the upstream adjustment segment 15 of the adhesive-backing apparatus 12 for the glue application, affixing of the capital band, and the pressing and with its downstream adjustment segment 16, it is finally transported further to the loading station 37.1 of the casing-in machine 10. The downstream adjustment segment 16 of the back-gluing apparatus 12, which is also the farthest downstream-arranged adjustment segment 16 of the transport and processing section 8, is operated for this within the adhesive-backing apparatus 12 with three operating cycles, each using a double step, and within the casing-in machine 10 with two operating cycles, using a single step.

The book block 3.1-*n*, prepared in this way while positioned on the transport and processing section 8, is conveyed in the loading station 37.1 of the casing-in machine 10 on one of its circulating saddle plates 9, and is conveyed further on this plate to the loading and grinding station 37.2 for the associated book cover 2.1-*n*. After these two book components have been supplied parallel to each other to the casing-in machine 10 and are combined therein to form a single book 4.1-*n*, the latter is conveyed further in circulating direction 22 of the casing-in machine 10 and is finally dispensed via the delivery station 37.3 to the non-depicted post-processing apparatus.

Figure 2:
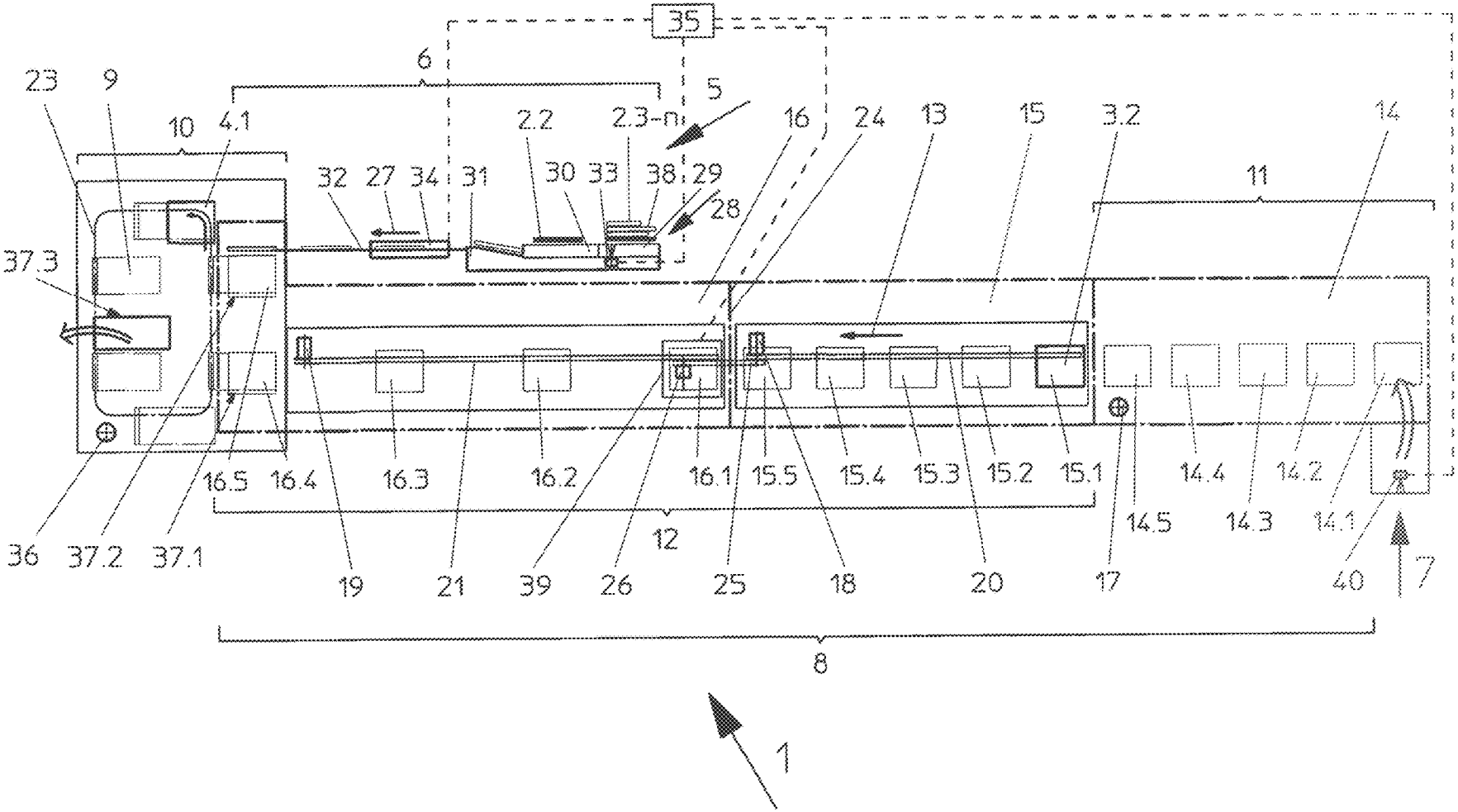
FIG. 2 is a representation of the book production line according to FIG. 1, but showing it one operating cycle later.

For the production of individual books 4.1-*n*, the successively following adjustment segments 14, 15, 16 of the transport and processing section 8 of the book production line 1 are always occupied alternately by a book block 3.1-*n* or not occupied by a book block 3.1-*n*. According to the snapshot shown in FIG. 1, a downstream book block position 16.5, located in the loading and grinding station 37.2 of the casing-in machine 10, of the downstream adjustment segments 16 of the adhesive-backing apparatus 12 is occupied by a first book block 3.1 for the current processing order for producing a first individual book 4.1 (FIG. 2). A book block position 14.5, located in a downstream region of the first adjustment segment 14, is occupied with a second book block 3.2 for a following production order to produce a second individual book 4.2, not shown herein, for which the format differs from the preceding production order. At the same time, the upstream adjustment segment 15 of the adhesive-backing apparatus 12 is also converted to the format for the second book block 3.2, corresponding to the following production order for the second individual book 4.2. The first book cover 2.1 is located in the downstream region of the transport section 6, meaning also in the loading and grinding-on station 37.2 of the casing-in machine 10. The second book cover 2.2 needed for producing the second individual book 4.2 was previously withdrawn from the stack 38 with the aid of the first transport device 29 of the transport section 6 and is currently positioned on its second transport device 30.

For producing individual books 4.1-*n*, the book production line 1 is operated such that a book block 3.1-*n* is transported or processed within one of the adjustment segments 14, 15, 16, thus resulting in a corresponding traversing time for the book block 3.1-*n*. During this traversing time, at least one of a following and a preceding adjustment segment is changed corresponding to the format for the following book block 3.1-*n*, thereby resulting in a corresponding format-conversion time. Since the longest format-conversion time can easily be computed ahead of time, based on the formats available in the machine control 35, meaning the dimensions for each book 4.1-*n* to be produced, the production speed for the book production line 1 is automatically adapted. This measure positively affects the output per hour of books 4.1-*n* to be produced.

Figure 4:
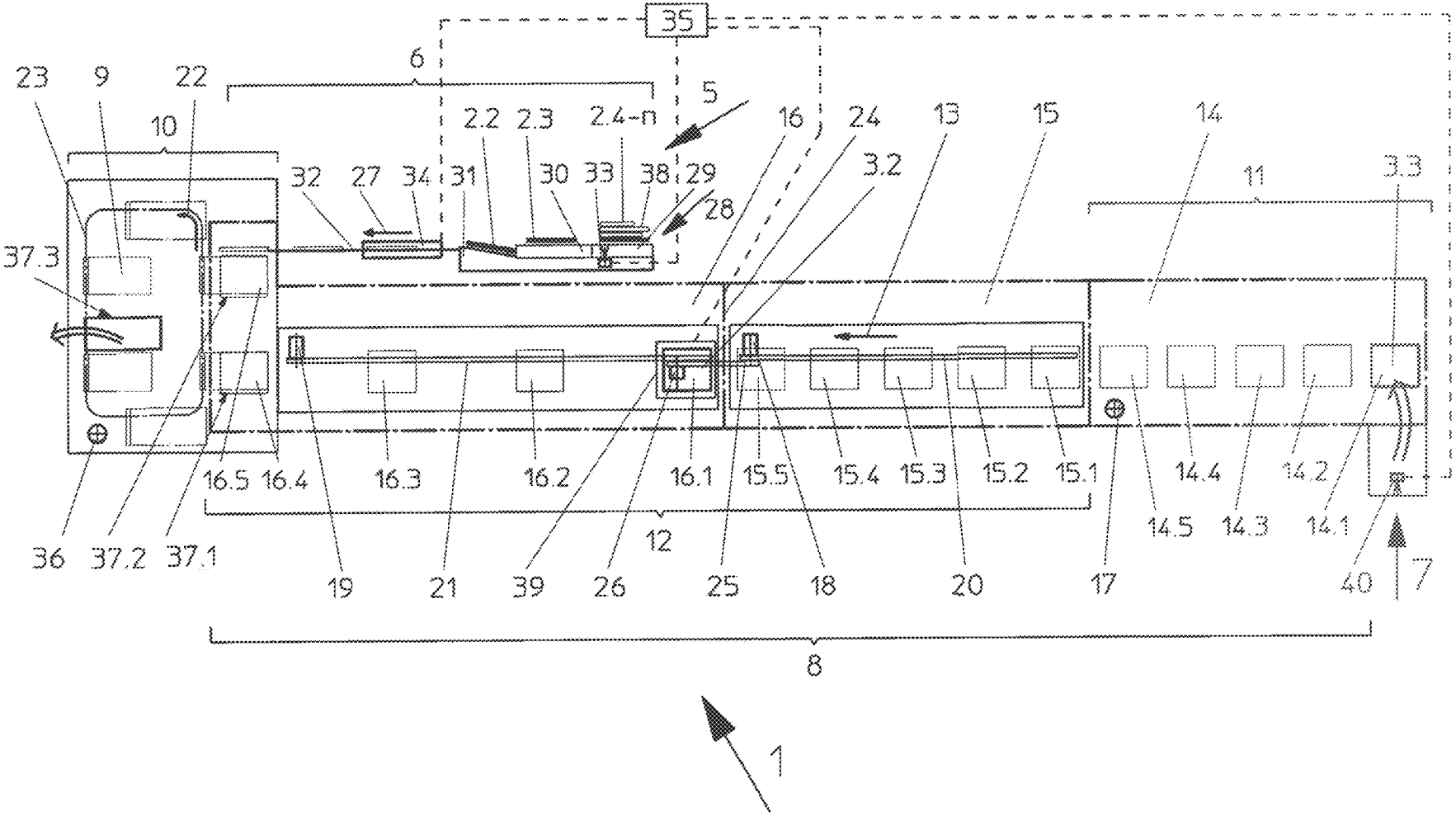
FIG. 4 is a representation of the book production line according to FIG. 1, but showing it six operating cycles later.

FIG. 2 shows the same book production line 1, but one operating cycle later than in FIG. 1. Accordingly, the second book block 3.2 is already located in the upstream book block position 15.1 of the upstream-arranged adjustment segment 15 of the adhesive-backing apparatus 12 that was previously converted to the format of this second book block 3.2. During the following transport of the second book block 3.2 in this adjustment segment 15, the downstream-arranged adjustment segment 16 of the adhesive-backing apparatus 12 is also adjusted to the format of this second book block 3.2. As needed, meaning if a third individual book 4.3, not shown herein, requires a different format than the second individual book 4.2, the first adjustment segment 14 can at this point also be converted to the format of a following, additional book block 3.3. (FIG. 4). In addition, the second book cover 2.2 continues to rest on the second transport device 30 of the transport section 6 while the downstream positioned hopper 31, from which the first book cover 2.1 has already departed, and the further downstream-arranged cover feeder 32 are adapted independent of each other to the format of the second book cover 2.2. Finally, the first individual book 4.1, formed with the book components previously positioned in the loading and grinding station 37.2 of the casing-in machine 10, has already been conveyed further by one operating cycle in the direction of the delivery station 37.3.

Figure 3:
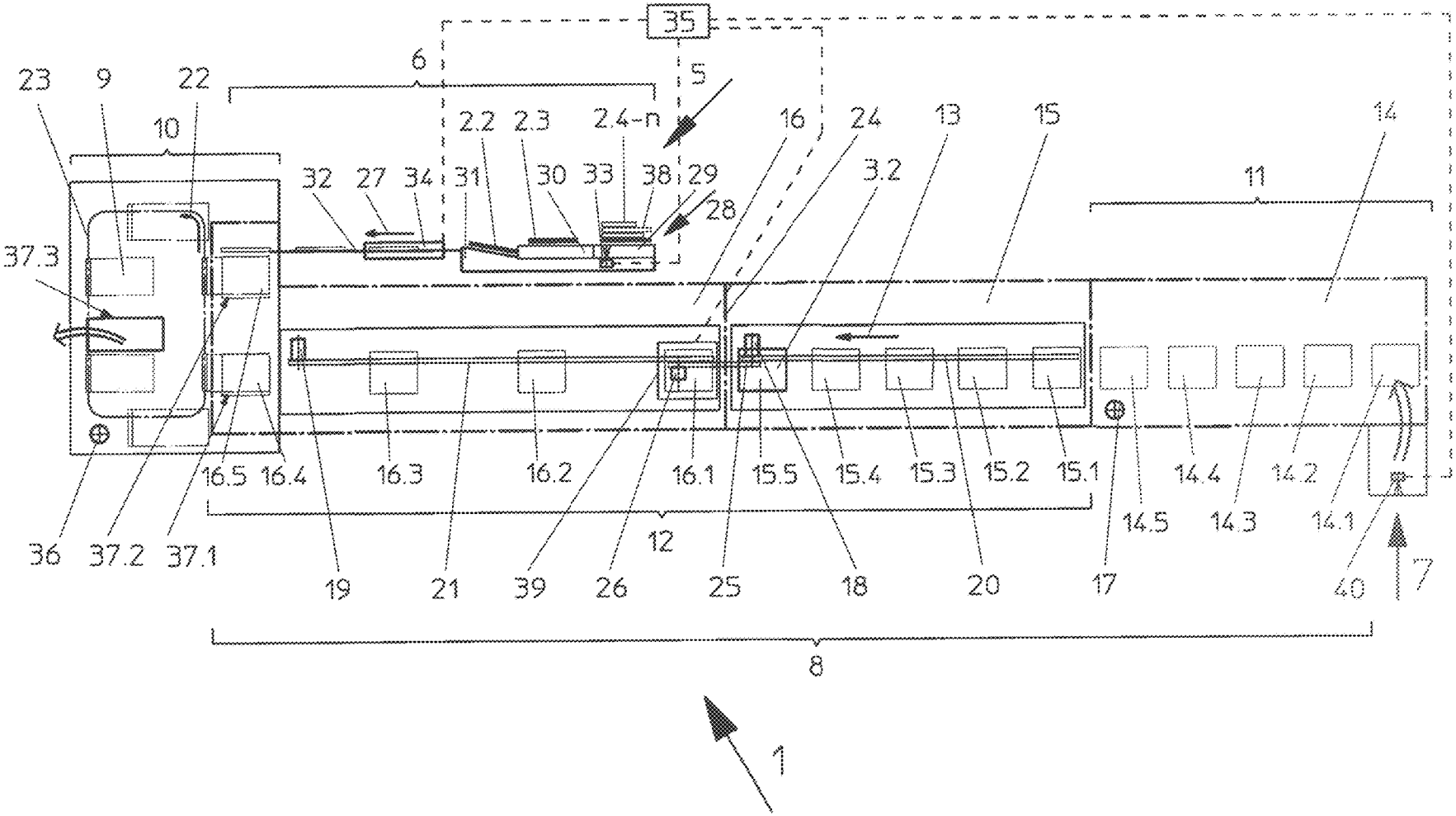
FIG. 3 is a representation of the book production line according to FIG. 1, but showing it five operating cycles later.

FIG. 3 also shows the same book production line 1, but five operating cycles later than in FIG. 1 or four operating cycles later than in FIG. 2. At this point in time, the second book block 3.2 is located in a downstream book block position 15.5 of the upstream adjustment segment 15 of the adhesive-backing apparatus 12, and the conversion of the first adjustment segment 14 as well as the downstream adjustment segment 16 of the adhesive-backing apparatus 12 is complete. The second book cover 2.2 is currently located in the hopper 31, previously converted to its format, and the third book cover 2.3 is located on the second transport device 30 of the transport section 6. The first individual book 4.1 has already been delivered via the delivery station 37.3 to the post-processing arrangement that is not shown herein.

FIG. 4 shows the same book production line 1, but six operating cycles later than in FIG. 1 and/or one operating cycle later than in FIG. 3. The second book block 3.2 is now located in the upstream book block position 16.1 of the downstream adjustment segment 16 of the adhesive-backing apparatus 12. In addition, a third book block 3.3 for a following production order for producing a third individual book 4.3 (not shown), with a different format than the preceding production order, is located in the upstream book block position 14.1 of the first adjustment segment 14. The accordingly empty, upstream-positioned adjustment segment 15 of the adhesive-backing apparatus 12 is adjusted to the format of this third book block 3.3. The second book cover 2.2 needed for producing the second individual book 4.2 is also still located in the hopper 31 of the transport section 6, awaiting call-up by the machine control 35 that is also operatively connected to the hopper 31. The book cover is called up once the book block 3.2, associated with the book cover 2.2, must traverse the same number of operating cycles in the adhesive-backing apparatus 12 as the book cover 2.2 for combining it to form the second individual book 4.2 (marriage). Starting with FIG. 4, this would occur one operating cycle later, meaning as soon as the book block 3.2 is in the position 16.2 and these two book components respectively still need to traverse three operating cycles until the marriage. The third book cover 2.3, needed for producing the third individual book 4.3, is located at the instant shown in FIG. 4 on the second transport device 30 of the transport section 6. The fourth book cover 2.4 is located in the stack 38 on the individual feeder 28 where it remains until the second book cover 2.2 has left the hopper 31 and the magazine has subsequently been converted to the format of the third book cover 2.3. The book covers 2.4-*n* needed for producing additional individual books 4.4-*n* are available in the stack 38 or the feed device 5, and the corresponding book blocks 3.4-*n* are available in its feed device 7.

Figure 5:
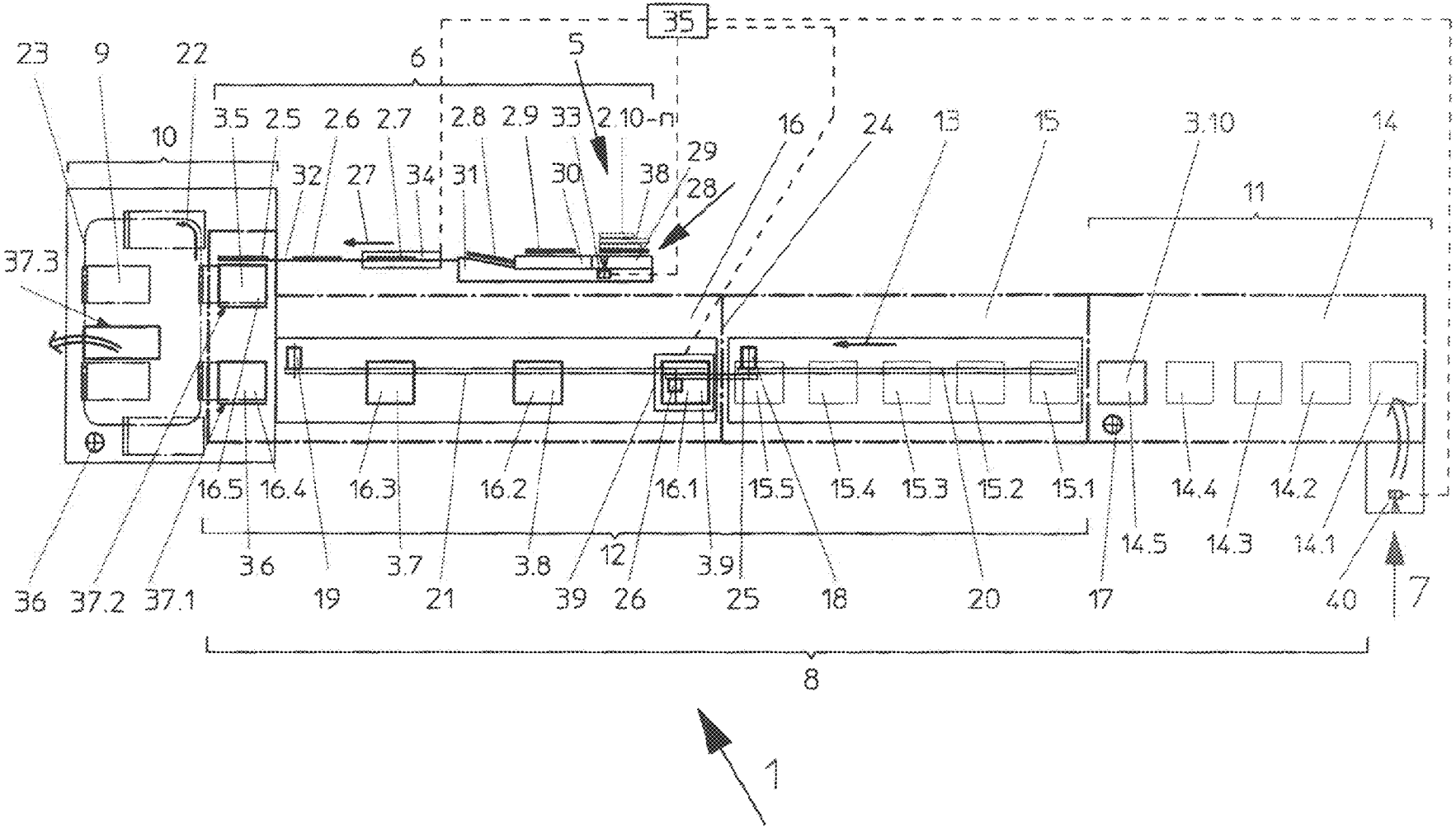
FIG. 5 is a schematic view of the book production line, used for producing a very short run of five books.

FIG. 5 shows a schematic view of an inventive book production line 1 for producing a very short run of five books 4.5-9, not shown herein, which are respectively composed of one book cover 2.5-9 and an associated book block 3.5-9. In this book production line are located five book covers 2.5, 2.6. 2.7, 2.8, 2.9 in the region of the transport section 6, previously identified by the detection device 33. The book blocks 3.5, 3.6, 3.7, 3.8, 3.9 belonging to the book covers 2.5, 2.6. 2.7, 2.8, 2.9 are positioned on the downstream adjustment segment 16 of the adhesive-backing apparatus 12. The book block 3.9, nominally belonging to the fifth book cover 2.9, is currently located in the upstream book block position 16.1 of the downstream adjustment segment 16 of the adhesive-backing apparatus 12. A removal station 39 for the book blocks 3.5-9 is furthermore arranged in this region of the downstream adjustment segment 16, so that in case of a mismatch between a book cover 2.5-9 and a book block 3.5-9, previously identified with an identification device 40 that is arranged upstream in the region of the transport and processing section 8, a book block 3.5-9 that does not belong to the book cover 2.5-9 can easily be removed at this location. For this, the detection device 40 and the removal station 39 are also operatively connected to the machine control 35 of the book production line 1. In the downstream book block position 14.5 of the first adjustment segment 14 of the transport and processing section 8, for example, an additional book block 3.10 is shown, which is combined with a corresponding book cover 2.10 into an individual book 4.10, following the successful production of the very short run of five books 4.5-9. The currently empty upstream-positioned adjustment segment 15 of the adhesive-backing apparatus 12 has already been converted for this to the format of the following book block 3.10.

Figure 6:
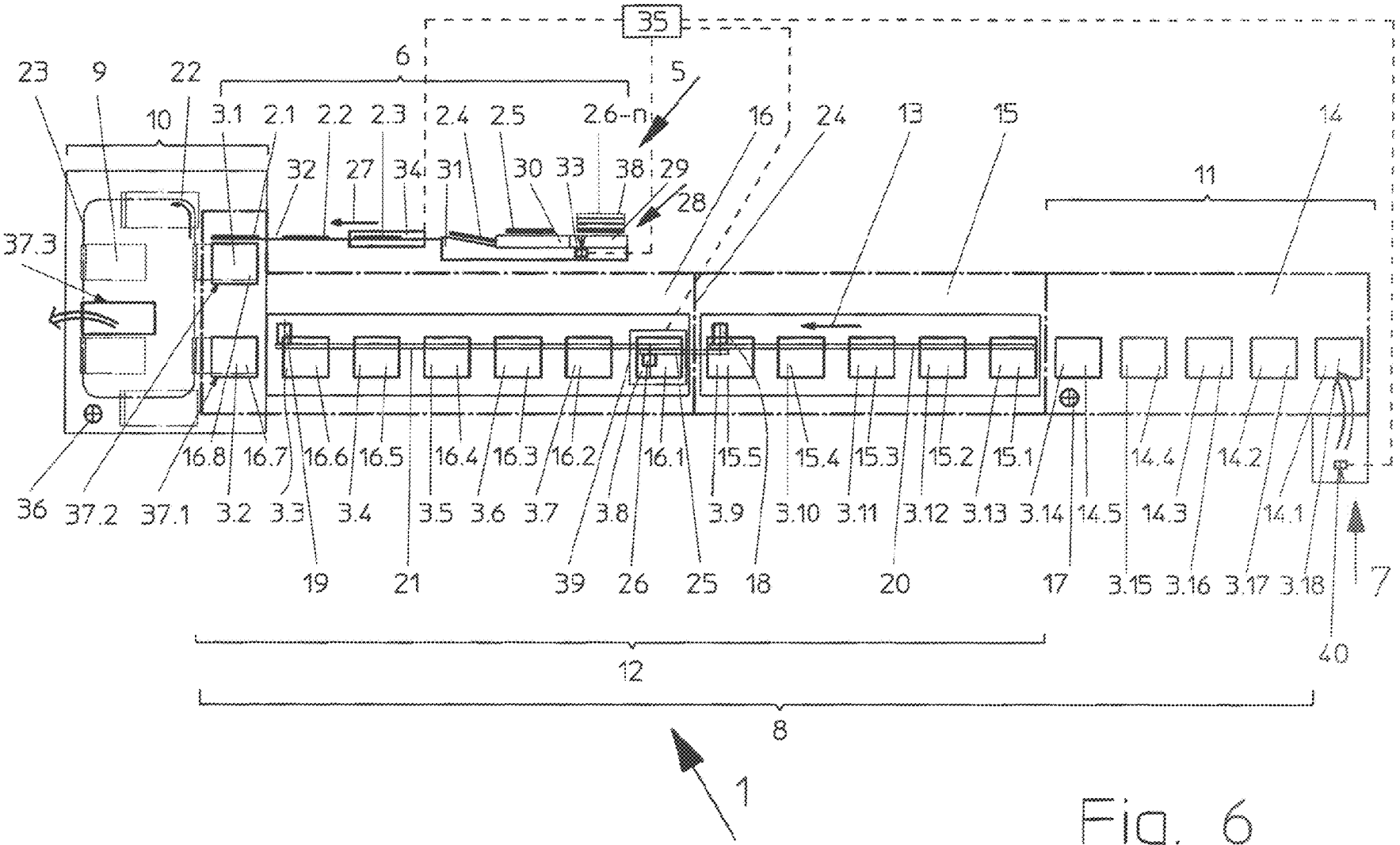
FIG. 6 is a schematic view of the book production line used for producing a short run of more than eighteen books.

As shown in FIGS. 1 to 5, the individual adjustment segments 14, 15, 16 of the transport and processing section 8 are intended each for holding maximally five book blocks 3.1-*n*, wherein the number of book block positions 14.1-5, 15.1-5, 16.1-5 of the three adjustment segments 14, 15, 16 is always the same. However, embodiments of the invention are conceivable where this number differs maximally by three book block positions. FIG. 6 thus shows a schematic view of the book production line 1 according to FIG. 1, but intended for producing a short run of more than eighteen books, wherein the adjustment segment 16 of the transport and processing section 8, which is located farthest downstream, has three book block positions more than each of the two upstream positioned adjustment segments 14, 15. That is the case, for example, if the adjustment segment 16 operates in the region of the adhesive-backing apparatus 12 with respectively a single step for the continuous operating cycles, meaning a single transport path, instead of traversing the operating cycles with a double step and thus a double transport path per operating cycles. For short runs, the single step is used because it makes possible a higher cycle number and the format conversion is not as relevant.

Consequently, it does not matter in principle which adjustment segment is longer or shorter. The respectively longest adjustment segment has the longest transit time for a book block. The book blocks in the shorter adjustment segments have at that point already completed the transit and must wait at the last book block position until the book block in the longest adjustment segment has also finished its transit. All book blocks are transferred only then into the next adjustment segment. When producing individual books, however, the operating and transit times through an adjustment segment increase with increased length of the longest adjustment segment, and the number of finished books per time unit decreases.

As previously described in the above, the double step can be switched in the adjustment segment 16 to single step for short runs, so that the number of books blocks located on the transport and processing section 8 is increased by three, but optimum conditions exist for a speed increase. The advantage of the double step or the resulting double transport path per operating cycle for reaching the same segment size is achieved with a somewhat lower processing speed that is sufficient for very short runs. However, with short runs, the machine speed prevails over the very low format conversion time since the processing time in that case is noticeably longer than the format conversion time. For the production of short runs, the ratio of processing time to format conversion time is up to 100:1, whereas this ratio is 1:1 for the individual book production.

Since the inventive book production line 1 is suitable for producing very short or short runs of books as well as individual books, the components of the book production line 1, which are shown and correspondingly described only in FIGS. 5 and 6 and include the detection device 40 and the removal station 39 for books blocks and which are used for producing a very short run of five books or a short run of at least 18 books, of course are also components of the production line 1 for producing individual books according to FIGS. 1 to 4, in the same way as the detection device 33 and the removal station 34 for book covers 2.1-*n*. Accordingly, the components used to form a book, meaning a book cover 2.1-*n* and the respectively associated book block 3.1-*n*, are initially clearly identified in the book production line 1. In case of a mismatch, a book block 3.1-*n* or a book cover 2.1-*n* is then automatically removed. In this way, combining mismatches can be avoided when producing individual books as well as very short and short runs of several books.

The book production line 1 shown in FIGS. 1 to 4, for producing individual books, comprises three adjustment segments 14, 15, 16 for book blocks 3.1-*n*, wherein each adjustment segment 4, 15, 16 can maximally hold five book blocks 3.1-5. In turn, this means that six operating cycles are required, including one for emptying one of the adjustment segments 14, 15, 16. With a production speed of 1800 operating cycles per hour, for example, this corresponds to a cycle time of 2 seconds. With six operating cycles, we thus have a transit time of twelve seconds for each adjustment segment 14, 15, 16. The maximum format conversion time from the minimum to the maximum format for the book blocks 3.1-*n* to be processed for those book production lines 1 should therefore also be less than/or equal to twelve seconds. With the book production lines 1 for very short and short runs of books, shown in FIGS. 5 and/or 6, several book covers 2.5-9 or book blocks 3.5-9 or several book blocks 3.1 to 3.18 with the corresponding book covers are thus transported or processed successively and simultaneously in the book production line 1. The machine control 35 can furthermore detect the transit time and the format conversion time to match the respective book block positions and/or operating cycles of respectively two successively following adjustment segments.

It will be understood that the above description of the present invention is susceptible to various modifications, changes and adaptations, and that the same are intended to be comprehended within the meaning and range of equivalents of the appended claims.

What is claimed is:

1. A book production line for producing individual books as well as very short and short runs of books, comprising:

a first feed device for book covers;

a transport section following the first feed device for transporting the book covers received from the first feed device;

a second feed device for book blocks;

a segmented transport and processing section following the second feed device for transporting the book blocks received from the second feed device in a transport direction;

a casing-in machine at a downstream end of the transport section and of the transport and processing section for combining a book cover and an associated book block to form a book;

wherein the segmented transport and processing section includes individual adjustment segments including:

an upstream first adjustment segment receiving the book blocks from the second feed device and comprising a rounding and pressing machine; and at least two downstream adjustment segments that constitute an adhesive-backing apparatus following the rounding and pressing machine and that successively follow each other in the transport direction;

wherein each of the upstream adjustment segment and the at least two downstream adjustment segments includes an associated separate drive and respectively have a number of book block positions;

wherein the adjustment segments of the adhesive-backing apparatus each include a separate transport device connected to the respective associated separate drive; and wherein the number of book block positions in each adjustment segment is identical or the number of book block positions in each adjustment segment maximally differs by three book block positions.

2. The book production line according to claim 1, wherein the individual adjustment segments for book blocks have five book block positions each.

3. The book production line according to claim 1, wherein the adjustment segments of the adhesive-backing apparatus have a separation location, and further including another transport device having a further separate drive arranged in a region that bridges the separation location.

4. The book production line according to claim 1, further including a machine control for the book production line, wherein one of the second feed device and the transport and processing section for book blocks comprises a detection device and the transport and processing section comprises a removal station for the book blocks that is arranged downstream of the detection device, wherein the detection device and the removal station are operatively connected to the machine control.

5. The book production line according to claim 4, wherein the removal station for book blocks is located in a region of an upstream-arranged book block position of a farthest downstream-arranged adjustment segment of the transport and processing section.

6. The book production line according to claim 5, wherein the farthest downstream adjustment segment of the transport and processing section comprises within the casing-in machine two downstream-arranged book block positions with a single transport path and comprises within the adhesive-backing apparatus three upstream-arranged book block positions with a double transport path.

7. The book production line according to claim 1, further including a machine control, wherein one of the feed device and the transport section for book covers comprises a detection device, and further including a removal station for book covers, arranged downstream of the detection device, wherein the detection device and the removal station are operatively connected to the machine control.

8. The book production line according to claim 1, wherein a farthest downstream adjustment segment of the transport and processing section comprises three more book block positions than any of the other adjustment segments.

9. A method for producing individual books as well as very short and short runs of books in the book production line according to claim 1, comprising:

separately supplying book covers and book blocks to the casing-in machine of the book production line, wherein respectively one book cover and an associated book block are combined in the casing-in machine to form a book, the separately supplying step comprising:

upstream of the casing-in machine, rounding and pressing book blocks in the first adjustment segment of the transport and processing section in which the book blocks are transported downstream toward the casing-in machine, each book block having a back; and following the rounding and pressing step, adhesively applying backing material to the backs of the book blocks while positioned on the at least two downstream adjustment segments of the adhesive-backing apparatus of the transport and processing section; and converting the book production line from a current production order with a first book format to a following production order with a second book format that differs from the first book format while maintaining a format conversion time of one of the downstream adjustment segments equal to or less than a transit time of a book block through the adjustment segment adjoining and upstream from the one downstream adjustment segment.

10. The method according to claim 9, wherein the separately supplying step includes transporting the book covers by the transport section, the method further including:

identifying the book covers transported by the transport section and the book blocks transported by the transport and processing section; and checking to determine whether each book cover and an associated book block are a match, and in case of a mismatch, automatically or manually removing at least one of the mismatched book cover and associated book block from, respectively, the transport section for book covers or the transport and processing section for the book blocks.

11. The method according to claim 9, wherein the adjustment segments, which follow successively in the transport direction of the book blocks, are either occupied or not occupied by book blocks alternately, the method further comprising conducting a format conversion of one of the adjustment segments during a time in which the one adjustment segment is not occupied by book blocks.

12. The method according to claim 9, comprising operating each of the adjustment segments with five operating cycles.

13. The method according to claim 12, wherein a farthest downstream-arranged adjustment segment of the transport and processing section connects the adhesive-backing apparatus and the casing-in machine, and further comprising operating the farthest-downstream arranged adjustment segment in the adhesive-backing apparatus with three operating cycles, respectively traversed in a double step, and operating the farthest-downstream arranged adjustment segment in the casing-in machine with two operating cycles to be traversed in a single step.

14. The method according to claim 9, wherein a farthest downstream-arranged adjustment segment of the transport and processing section connects the adhesive-backing apparatus and the casing-in machine, and further comprising operating the adhesive-backing apparatus with six operating cycles, respectively traversed in a single step, and operating the casing-in machine with respectively two cycles, traversed in a single step.

* * * * *